US006327854B1

(12) United States Patent
Bonny et al.

(10) Patent No.: US 6,327,854 B1
(45) Date of Patent: Dec. 11, 2001

(54) FASTENING AN EXHAUST MANIFOLD TO AN ENGINE CYLINDER HEAD

(75) Inventors: Pierre Bonny, Hamburg; Thomas Hülsberg, Buchholz; Hans-Jörg Kaifel, Winterbach; Holger Nuhn, Soltau; Thorsten Sternal, Moisburg; Gerd Tiefenbacher, Stuttgart, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/558,632

(22) Filed: Apr. 26, 2000

(30) Foreign Application Priority Data

May 6, 1999 (DE) ..... 199 20 822

(51) Int. Cl.[7] ..... F01N 7/10
(52) U.S. Cl. ..... 60/323; 60/321; 60/322
(58) Field of Search ..... 60/323, 321, 322; 277/593, 598, 591, 600, 601

(56) References Cited

U.S. PATENT DOCUMENTS

| | | | | |
|---|---|---|---|---|
| 3,712,064 | * | 1/1973 | Kuhn | 60/323 |
| 4,168,610 | * | 9/1979 | Engquist | 60/322 |
| 4,184,329 | * | 1/1980 | Ruesch | 60/323 |
| 4,214,444 | * | 7/1980 | Fujioka et al. | 60/322 |
| 5,463,194 | * | 10/1995 | Ransom et al. | 181/240 |
| 5,566,548 | * | 10/1996 | Khurana | 60/322 |
| 5,600,950 | * | 2/1997 | Ottenschlaeger | 60/323 |
| 5,636,515 | * | 6/1997 | Matsumoto et al. | 60/323 |

FOREIGN PATENT DOCUMENTS

| | | | | |
|---|---|---|---|---|
| 2153440 | * | 6/1972 | (DE) | 60/322 |
| 197804 | * | 4/1978 | (DE) | 60/322 |
| 3828723 | | 3/1989 | (DE) . | |
| 4126744 | | 2/1993 | (DE) . | |
| 19635870 | | 3/1998 | (DE) . | |
| 19807312 | | 8/1999 | (DE) . | |
| 2694608A1 | * | 2/1994 | (FR) . | |
| 0023517 | * | 1/1987 | (JP) | 60/322 |
| WO91007576 | * | 5/1991 | (WO) | 60/322 |

* cited by examiner

*Primary Examiner*—Thomas Denion
*Assistant Examiner*—Diem Tran
(74) *Attorney, Agent, or Firm*—Crowell & Moring LLP

(57) ABSTRACT

An apparatus and method of attaching an exhaust manifold to an engine's cylinder head utilizing an oversized hole in the manifold, a stud fastener extending through the oversized hole, a spacer element around the stud fastener, and a nut adapted to be tightened to engage the spacer element and the flange wherein a flat gasket is compressed to a desired extent which is not so excessive that it inhibits sliding movement caused by thermal growth of the manifold.

7 Claims, 2 Drawing Sheets

FASTENING AN EXHAUST MANIFOLD TO AN ENGINE CYLINDER HEAD

CROSS REFERENCE TO RELATED APPLICATIONS

Priority is claimed under 35 U.S.C. 119 with respect to German Patent Application 199 20 822.0-13 filed on May 6, 1999.

BACKGROUND OF THE INVENTION

Field of the Invention

This invention relates to an arrangement for fastening an exhaust manifold on to the cylinder head of an internal combustion engine.

An exhaust manifold of the generic type is disclosed in DE 196 35 870 A, and a typical earlier fastening of the exhaust manifold to the cylinder head can be seen from DE 38 28 723 A.

To accommodate thermal growth or expansion of the exhaust manifold and inhibit warping, the manifold's flanges which are used to attach it to a cylinder head permit sliding movement of the manifold along the sealing surface with the engine, along either a seal member of the actual surface of the cylinder head itself. For this purpose, holes in the inlet flanges of the manifold are made larger than the diameters of the fasteners, either bolts or studs and nuts, and are designed as slots. However, the fasteners have to be tightened with a defined torque to extremely small tolerances, e.g. 16 Nm±1 Nm to both permit desired sliding movement and also adequate sealing. In an installation where several fasteners are installed in series for a given manifold, much time is expended to satisfy attach the manifold because the fasteners must be tightened in sequence and gradually using at least two torque settings for the installation tool. In addition to this difficulty, there is only a small degree of certainty of a proper reinstallation of a manifold after servicing in the workshop where such narrow tolerances likely cannot be achieved.

SUMMARY OF THE INVENTION

The object of the invention is to provide an apparatus and method of installation of an exhaust manifold without defining a very specific tightening torque but permitting desirable sliding movement of the manifold along the cylinder-head surface while still maintaining good sealing.

In the arrangement and proposal according to the subject invention, the fasteners in the form of nuts are threaded onto studs by means of commonly used tools until they engage spacer elements which is readily accomplished in a short period of time. The length dimension of the shank portion of the spacer element is determined such that, with a nut tightened on to the stud to the aforedescribed engaging extent, sliding movement of the manifold's flange is not prevented. Also, sealing is assured against a typical multi-layered gasket member which is positioned beneath the flange. The spacer element design does not permit the surface contact between the manifold and cylinder head to be excessive so as to inhibit thermal growth.

The spacer element may be in the form of a bushing which is inserted into the manifold's hole and with an internal diameter greater than the diameter of the stud with the result that the manifold flange is permitted to be displaced upon thermal expansion of the exhaust manifold. The end of the spacer element which is adjacent the nut fastener may be provided with a collar portion adapted to engage the exterior of the manifold. Alternatively, the nut itself may include a collar portion with the collar engaging the manifold flange outwardly of the spacer bushing. This spacer bushing may be produced, for example, as a cost-effective turned part, an extruded part, or a sintered metal formed part. In order to facilitate assembly in a plant, the spacer bushing may be connected to the flange in captive fashion, e.g. by adhesive bonding or lightly pressing in the associated hole.

It is also possible for the spacer bushing to be integral with the nut fastener, in which case the nut is designed as a collar nut and the collar portion engaging the manifold's flange portion.

Finally, it is also possible for the spacer element to be integral with the stud but with its diameter smaller than the flange's hole in order to allow the flange to be move in a slidingly manner. In this case, the nut might be designed as a collar nut, of which the collar portion engages the flange outside the spacer portion of the stud.

BRIEF DESCRIPTION OF THE DRAWINGS

Several exemplary embodiments of the invention are described hereinbelow with reference to the drawings, in which.

DETAILED DESCRIPTION OF THE PREFERRED EMBODIMENTS

Figure 1:
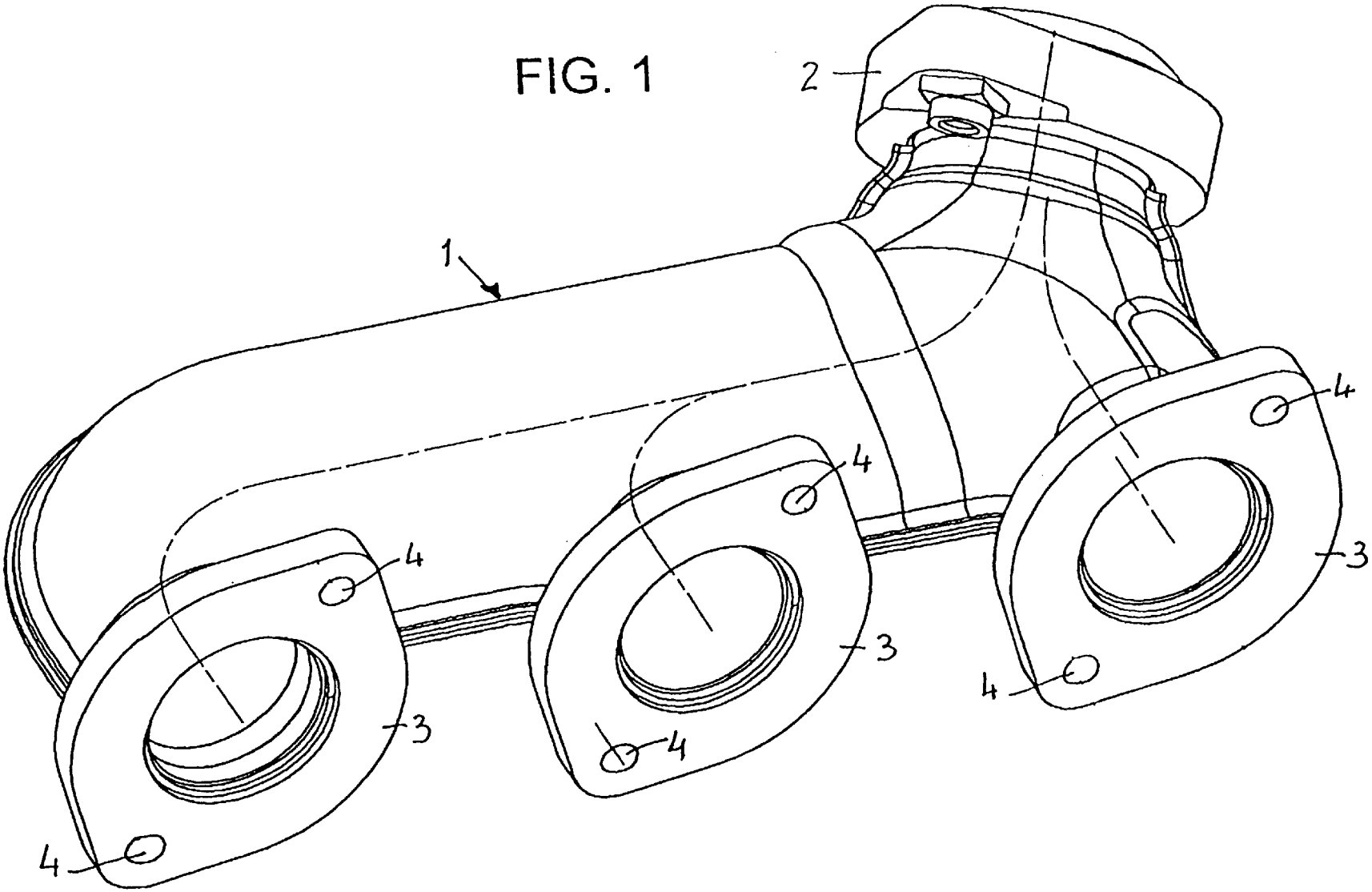
FIG. 1 is a perspective view of an exhaust manifold.
Figure 2:
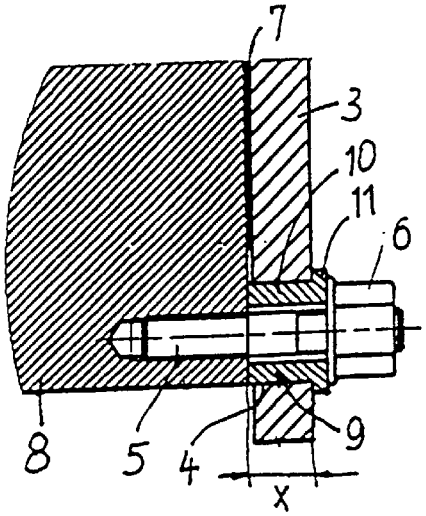
FIG. 2 is a sectioned elevational view of an inlet flange of the exhaust manifold in assembled condition as attached to the associated cylinder head using a first exemplary embodiment of the spacer element.
Figure 4:
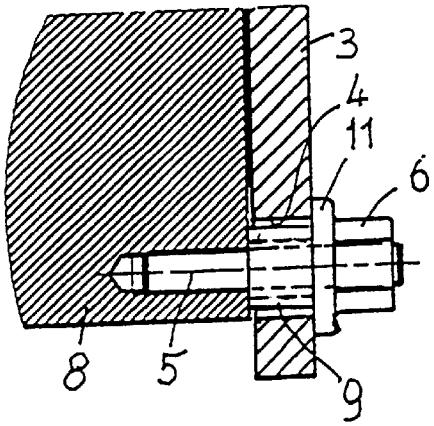
FIG. 4 is a sectioned elevational view of an inlet flange of the exhaust manifold in assembled condition showing a second exemplary embodiment of the spacer element.
Figure 5:
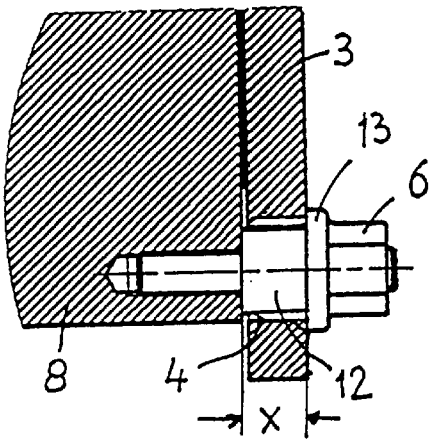
FIG. 5 sectioned elevational view of an inlet flange of the exhaust manifold in assembled condition showing a third exemplary embodiment of the spacer element.

In FIG. 1, an exhaust manifold 1 for an internal combustion engine is shown which has an outlet flange 2 and several inlet flanges 3. Each inlet flange 3 is provided with typically two holes 4 through which fasteners are extended, as is shown in FIGS. 2, 4 and 5 for attaching the manifold to an associated cylinder head 8 of an engine. Threaded screw holes are provided in the cylinder head 8 into which stud fasteners 5 are threadably inserted leaving a threaded portion extending outwardly from the exterior surface of the cylinder head. Nut fasteners 6 are threadably provided on to the outwardly extending ends of the studs 5. I In this manner, each inlet flange 3 of the manifold 1 is securely attached to the cylinder head 8. Typically, a flat gasket member 7 is interpositioned between the cylinder head 8 and the manifold flange 3.

Figure 3:
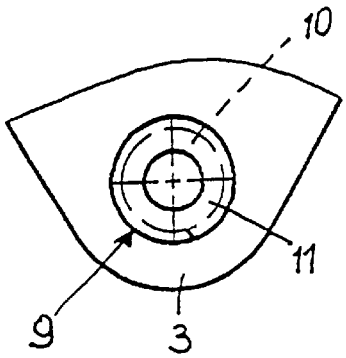
FIG. 3 is a plan view of an inlet flange of the exhaust manifold in assembled condition showing an inlet flange of the manifold.

In a first exemplary embodiment shown in FIGS. 1 and 3, a spacer bushing 9 is inserted into each hole 4 of the manifold over a stud 5. The spacer bushing 9 has a shank portion 10 and a collar portion 11. The length X of the shank portion 10 corresponds to the exact thickness of the flange 3 plus the thickness of the flat gasket 7 when it is desirably compressed to its after-installation value. When a nut 6 is tightened to engage the collar portion 11, this causes the inner end of the shank portion 10 to engage the cylinder head 8. At the same time, the collar portion 11 engages the exterior surface of the flange 3. Consequently, the gasket 7 is compressed to an extent needed for reliable sealing but allowing sliding displacement of the inlet flange 3 relative along the surface of the cylinder head 8 due to the clearance or play between the stud fastener 5 and the spacer bushing 9.

If the spacer bushing 9 is designed without a collar portion 11 and the nut fastener 6 is designed as a collared nut, the spacer bushing 9 may be operatively connected to the flange 3 during pre-installation in a captive fashion, for example by adhesive bonding or being pressed into the hole. This construction will be described hereinafter in reference to FIG. 5.

In FIG. 4, a second exemplary embodiment of the fastener and spacer is shown. It differs from that of FIG. 2 by making the spacer bushing 9 is integral with nut fastener 6. In this case the necessary lateral play is provided between the spacer bushing portion of the nut and the hole 4 as shown. In installation, the spacer nut 6 with its spacer bushing portion 9 is threaded onto stud member 5 such that the inner end of the bushing portion 9 engages the surface of the cylinder head 8. At the same time, the radially enlarged portions of the nut portion 6 engage the outer surface of flange 3.

In FIG. 5, a third exemplary embodiment is shown in which a spacer element is the form of a cylindrical portion 12 of the stud 5 and integral therewith. The cylindrical portion 12 is sized to provide lateral play with respect to flange hole 4. Resultantly, the flange 3 can be displaced relative to the cylinder head 8 in a sliding movement parallel to the surface of the cylinder head 8. The length of the cylindrical portion 12 corresponds, in turn, to the value X in FIG. 2. In this case, the nut 6 is designed as a collar nut so that the radially enlarged edge portion of the collar 13 engages the outer surface of the flange while the more radially inward portion of the nut 6 engages the outer end of the cylindrical portion 12.

It should be understood that various changes and modifications can be made in devices described above without departing from the spirit of the invention. Such changes and modifications are contemplated by the inventor and he does not wish to be limited except by the scope of the appended claims.

We claim:

1. An arrangement for fastening an exhaust manifold (1) on to a cylinder head (8) of an internal combustion engine, the manifold having an inlet flange (3) with at least one hole (4), a threaded fastener (5) extending through the hole and attached to the cylinder head (8) by means of which the flanges (3) are secured to the cylinder head (8), and a flat gasket (7) interpositioned between the manifold and cylinder head and including a device to effectively space the manifold from the cylinder head to allow sliding movement therebetween caused by thermal growth comprising: a spacer element (9;12) seated between the fastener and the cylinder head and sized relative to the hole so as to provide a lateral clearance supported on the cylinder head (8) and having a length dimension less than the thickness of the manifold flange to an extent sufficient to desirably compress the gasket for providing sufficient sealing but also to limit the clamp load imparted by the threaded fastener on the connection between the exhaust manifold, gasket, and cylinder head to allow lateral sliding movement of the manifold relative to the cylinder head caused by thermal growth of the manifold.

2. The attachment arrangement as set forth in claim 1 in which the threaded fastener is a stud mounted on the cylinder head and a nut threadable on the stud, the spacer element having the form of a spacer bushing (9) for insertion into the hole of the flange and having an internal bore therethrough of a diameter greater than the diameter of the stud (5).

3. The attachment arrangement as set forth in claim 2 in which the spacer bushing (9) has a radially outwardly extending collar portion formed on its end adjacent to and engaged by the nut (6) and which also engages the flange (3).

4. The attachment arrangement as set forth in claims 2 or 3 and with the spacer bushing (9) connected to the flange (3) in captive fashion for pre-installation unity.

5. The attachment arrangement as set forth in claim 2 and a collar portion (11) integral with the nut (6) and adapted to engage the flange (3) radially outward from the spacer bushing (9).

6. The attachment arrangement as set forth in claims 2 or 3, characterized in that the spacer bushing (9) is integral with the nut (6).

7. The attachment arrangement as set forth in claim 1 in which spacer element (12) is formed integrally with the stud fastener (5) and its diameter dimension is less than the dimension of hole (4), and nut (6) has a collar portion adapted to engage the flange (3) outwardly of the spacer element (12).

* * * * *